United States Patent [19]

Oldendorf

[11] 4,060,253

[45] Nov. 29, 1977

[54] METHOD AND APPARATUS FOR SKATEBOARD SUSPENSION SYSTEM

[76] Inventor: Eric W. Oldendorf, 2805 Angelo Drive, Los Angeles, Calif. 90024

[21] Appl. No.: 664,812

[22] Filed: Mar. 8, 1976

[51] Int. Cl.[2] ..... A63C 17/00

[52] U.S. Cl. ..... 280/87.04 A; 280/11.28

[58] Field of Search ..... 280/87.04 A, 87.04 B, 280/87.04 R, 87.01, 87.02, 81 A, 661, 11.27, 11.28, 11.19, 11.3, 11.37 E

[56] References Cited

U.S. PATENT DOCUMENTS

| | | | |
|---|---|---|---|
| 240,800 | 4/1881 | Winslow | 280/11.28 |
| 289,099 | 11/1883 | Hipkiss | 280/11.28 |
| 1,510,585 | 10/1924 | Cushing, Sr. et al. | 280/87.02 R |
| 2,330,147 | 9/1943 | Rodriguez | 280/87.04 A |
| 2,510,722 | 6/1950 | Snyder | 280/11.28 |
| 3,235,282 | 2/1966 | Bostick | 280/87.04 A |
| 3,331,612 | 7/1967 | Tietge | 280/87.04 A |
| 3,565,454 | 2/1971 | Stevenson | 280/87.04 A |

*Primary Examiner*—Joseph F. Peters, Jr.
*Assistant Examiner*—David M. Mitchell
*Attorney, Agent, or Firm*—Brown & Martin

[57] ABSTRACT

Angle pads are removably sandwiched between the truck assemblies and boards of skateboards. These pads have upper and lower surfaces with different interface angles with the respective truck assemblies and boards, that increase or decrease the pivot angle of the truck assemblies relative to the boards and thus selectively change the amount of board tilt required to provide a desired turning of the axles and wheels through the truck assemblies. Thus the angle pads allow selective changing of the magnitude of turning of either the front or rear truck assemblies and wheels to achieve exceptional turning ability or high speed stability.

9 Claims, 6 Drawing Figures

METHOD AND APPARATUS FOR SKATEBOARD SUSPENSION SYSTEM

BACKGROUND OF THE INVENTION

A skateboard device normally has roller skate type trucks and wheels positioned at each end of a somewhat flexible board. The board is operated by placing the user's feet on the board and maneuvering the turning angle of the wheels by tilting the board. Riding a skateboard is thus very similar to riding a surfboard.

The skateboard suspension system provides a front truck assembly, a rear truck assembly and wheels carried on the truck assemblies. In such assemblies, the truck normally positions the angle of turning of the axles and wheels at a 45° angle to the board. Accordingly, tilting movement of the board causes a turning moment to the axle and thus the wheels.

The general object of the skateboard suspension system is to provide ride smoothness, general board stability, and turning ability, through a relatively inexpensive, standardized truck assembly. The standardized truck assemblies are normally standardized at the angle of axle pivot of 45°. This provides medium turning ability with compromised instability at relatively high speeds.

It is therefore advantageous to have a new and improved skateboard suspension system, in which high speed stability can be achieved along with exceptional turning ability through making quick and easy changes to the suspension of the skateboard.

SUMMARY OF THE INVENTION

In an exemplary embodiment of the invention, the skateboard has an interface between the user and the ground. This interface is the board, the truck assembly and the wheels. The board supports the user and the trucks translate tilting of the board into changing of direction. In the preferred embodiment angle pads are inserted between the truck assembly and the board that changes the fixed pivot angle of the truck relative to the board. The pivot angle is the angle of inclination of the truck and wheel assembly relative to the board. In normal truck construction this angle is 45°. This is the angle which sets the ratio between tilt and wheel turn that is selectively varied by the pads.

The angle pads have an upper surface and a lower surface that have different angle planes. The pads, when inserted between the truck assemblies and the board, change the relative angle of the pivot of the truck assembly relative to the board. It can be increased or decreased, thus increasing or decreasing the turning angle of the wheels.

The pads may be inserted so the front truck and wheel assembly has a greater effective pivot angle than that of the rear truck assembly. This increases the stability of the board at high speeds as the rear truck assembly acts similar to the suspension system of an automobile. Alternatively, the rear truck assembly may be given a greater effective pivot angle than the front truck assembly, which then allows greater turning of the rear wheels and axle and thus increases the turning ability that may be generated in tight quarters. Another arrangement is where the pivot angle of the truck assemblies are increased the same amount on both front and rear wheels. This increases the turn ability of the board or where the angle is decreased, makes the board exceptionally stable at high speeds.

It is therefore an object of this invention to provide a new and improved method and apparatus for providing a skateboard suspension system, wherein the pivot angle of the front and rear truck assemblies may be selectively varied to achieve improved turning angles of the board or stability at high speeds.

Other objects and many advantages of this invention will become more apparent upon a reading of the following detailed description and an examination of the drawing wherein like reference numerals designate like parts throughout and in which.

Figure 2:
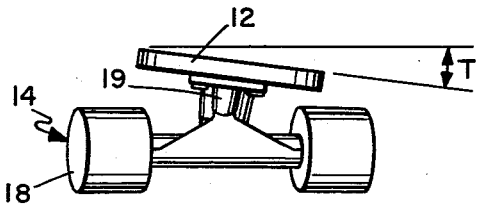
FIG. 2 is a front elevation view illustrating the effect of tilting the skateboard and turning the wheels.

Referring now to the drawing, a typical skateboard 10 has a board 12 supported by front and rear truck assemblies 14 and 20. The truck assemblies control the positioning and angle of the axle 17 and wheels 18 and 24. The board 12 is normally flexible but has sufficient size to allow a user to place his feet thereon and manipulation of the feet tilts the board as illustrated in FIG. 2. The truck assemblies have a pivot relationship relative to the axle 17 that rotates around pivot points 19 and 21 between the axle 17 and the mounting bracket of the truck assembly. This pivot angle is at an angle to the board so that when the board is tilted this forces the wheel to move to the rear on the side of the tilt. This assumes that the installation of the truck asembly is that of a typical skateboard, wherein the pivot angles are directed toward the mid-point of the board and are inclined downwardly.

Figure 4:
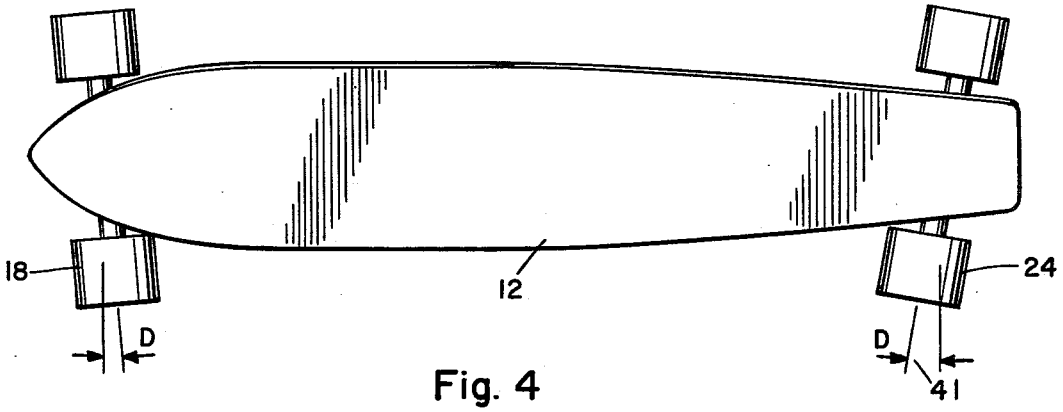
FIG. 4 is a top plan view of a skateboard showing the relationship of the wheel deflections for the installation illustrated in FIG. 5.

A typical truck assembly, as illustrated, provides a pivot angle P of about 45°. This pivot angle P is fixed for each truck assembly and thus for each skateboard. The amount of turning of the wheels, for a given tilt of the board 12, is directly proportional to the amount of tilt times the sine of the angle of pivot P. The deflection, such as deflection D or 38 in FIG. 4 is the amount of turning.

The formula for this is as follows:

$T$ = the angle of the tilt of the board $D$ = the angle of deflection of the axle 17 on the ground $P$ = the angle of the axle pivot So $D = f(T, P)$ and $D = T \text{ SIN } (P)$ Thus if $P = 45°$ then $D = T \text{ SIN } (45°)$ and D = T (0.70)

For a normal skateboard suspension system, the above relationship exists between the board and truck assemblies. Thus for a tilt T of 20° there will be a corresponding deflection D of 14°. It may be observed that the greater the angle of axle pivot P and the greater the tilt T, then the greater the deflection D.

In using skateboards, the larger the deflection D for a given tilt T makes the board turn in a tighter radius and thus is more maneuverable. On the other hand, the less deflection D for a given tilt T makes the board have more travel stability at high speeds.

Figure 3:
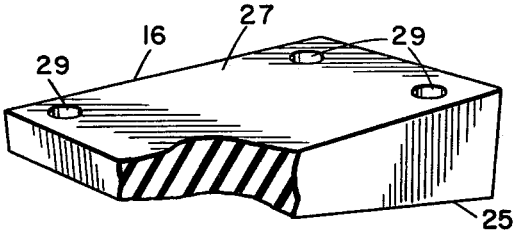
FIG. 3 is a perspective view, partially cut away, of a typical angle pad.

In FIG. 3, there is illustrated a wedge block or angle pad that has a flat lower surface 25 and a flat upper surface 27, both of which lie in places that have intersecting angles corresponding with the wedge shape. The pad 16 has openings 29 therethrough for passing bolts in securing the pads in position.

These wedge blocks or angle pads 16 are inserted between the flat upper surface 32 of the truck assemblies and the lower, underneath surface of the board 12. The magnitude of the angle between the upper and lower surfaces of pad 16, and the direction of positioning of the respective blocks for each truck assembly, determines whether the angle of the block R adds to or subtracts from the normal pivot angle of the truck assembly, and thus either makes the overall angle position of the wheels supported by the particular truck assembly more responsive to tilt T or less responsive to tilt T in providing turning movement or deflection D, and thus becomes either more maneuverable or have more stability.

Figure 1:
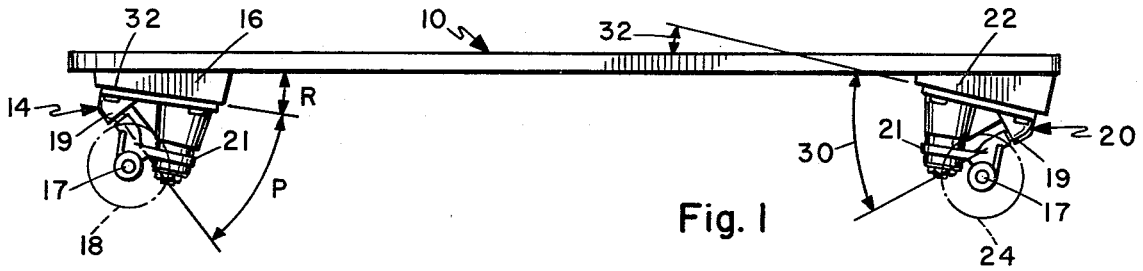
FIG. 1 is a side elevation view of a typical skateboard with the angle pads installed.

Referring now to FIG. 1, the skateboard 10 moves in a direction to the left. Accordingly the angle pads 16 is so arranged to increase the pivot angle P by the angle R of pad 16. So in calculating the amount of deflection D, since the angle P is increased by the angle R, the total deflection of D for a given amount of tilt T is increased.

The rear truck assembly 20 however has an angle pad 22 that is arranged to provide a negative angle R to the axle pivot angle 30. This angle 32 (R) is thus subtracted from the angle 30 (P) giving an axial pivot angle P of less than 45°. Accordingly in the above referenced formula, the deflection D for a given rear amount of tilt T will decrease.

In the embodiment of FIG. 1, for a given side tilt, the front wheels will deflect a greater amount than the rear wheels. This action is similar to that of an automobile wherein the rear wheels have a relatively fixed orientation, thus increasing the stability of the skateboard at high speeds. If the position of pad 16 were reversed then both the front and rear truck assemblies would have less than the normal angle of axial pivot P and thus would have poor turning ability and have even greater high speed stability.

Figure 5:
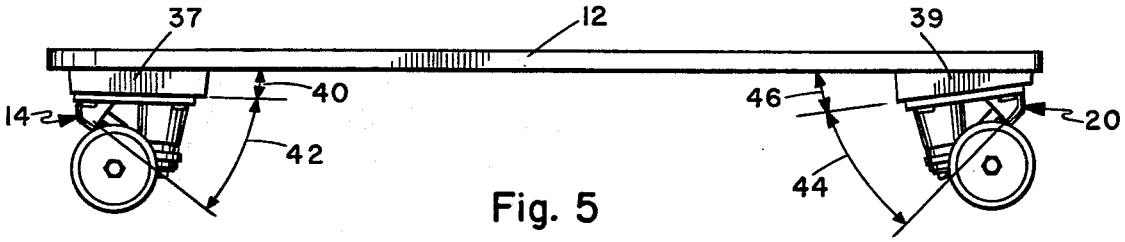
FIG. 5 is a side elevation view of an alternative angle pad installation arrangement.

Referring to FIG. 5, the angle pads are reversed from that of FIG. 1. Thus with rear pad 39, the angle of axial pivot 44 (P) for the rear truck assembly 20 is increased by the angle 46 (R) providing a greater deflection D for a given tilt of the board 12. The front pad 37 is positioned to provide a negative angle 40 (R) from the pivot angle 42 (P) providing less wheel deflection or turning for a given tilt of board 34. As illustrated in FIG. 4, the deflection angle for a given tilt of the board 34 provides more turning angle or deflection 41 (D) for wheels 24. This arrangement provides for greater maneuverability of the board, but less stability at high speeds.

Figure 6:
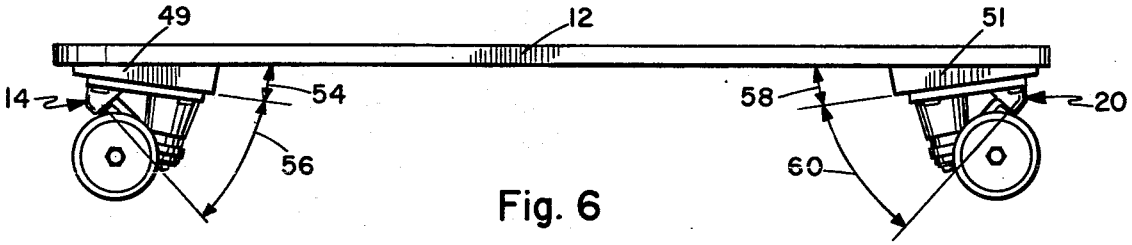
FIG. 6 is a side elevation view showing another angle pad installation arrangement.

Referring to FIG. 6, the board 12 has a forward pad 49 and a rearward pad 51, both of which are arranged to provide positive R angles 54 and 58 that are added to the respective angles of axle pivot (P) 56 and 60. Thus both these forward and rear truck assemblies have greater deflections D for given tilt T, providing a more maneuverable board.

It may be understood that the angle pad 16 may be made of any suitable material such as hard rubber, plastic or the like. Holes 29 provide for securing the pad 16 in a sandwiched, rigid position between the truck assembly and the board. The pads 16 may be selected to have upper and lower relative surface angles to provide selective changes in deflection. The pads 16 may be quickly and easily inserted into the skateboard suspension system to provide the type of stability or turning that is desired. The thickness of the pads also increase the spacing distance between the board and the wheels, permitting larger tilting of the board without contacting the wheels.

Having described my invention I now claim:

1. In a skateboard having a board and front and rear truck assemblies for supporting the board, each truck assembly having wheels rotatably mounted on an axle which is pivotally mounted at a pivot angle to a mounting bracket, the improvement comprising:

angle pad means for being removably sandwiched between the truck assemblies and the board for supporting said board on said truck assemblies, and said pad means comprising an individual pad for each truck assembly, each of said pads having interface angles respectively with the truck assemblies and board for altering the effective pivot angle of the truck assemblies between the board and the wheels.

2. In a skateboard as claimed in claim 1, wherein:

each of said pads having an upper surface and a lower inclined surface, and said upper surface abutting against the lower surface of the board and the lower surface resting against a flat upper surface of the truck assembly for supporting the board on the truck assembly.

3. In a skateboard as claimed in claim 2, wherein:

the lower surface of the front and rear pads being inclined upwardly towards the respective front and rear ends of the board, thereby increasing the pivot angle of the front and rear truck assemblies relative to the board for moving the wheels in a pivoted turn to a greater amount with corresponding tilting of the board.

4. In a skateboard as claimed in claim 2, wherein:

the lower surface of the front and rear pads being inclined upwardly towards the front of the board, thereby increasing the pivot angle of the front truck assembly and decreasing the pivot angle of the rear truck assembly relative to the board for moving the front wheels in a pivoted turn a greater amount for a corresponding tilt of the board while the rear wheels move a lesser amount increasing the stability of movement of the skateboard at higher speeds.

5. In a skateboard as claimed in claim 2, wherein:

the lower surface of the front and rear pads being inclined upwardly toward the center of the board, thereby decreasing the pivot angle of the front truck assembly and decreasing the pivot angle of the rear truck assembly increasing the amount of wheel turn of the rear wheels and decreasing the amount of wheel turn for the forward wheels with a corresponding tilting of the board.

6. In a skateboard as claimed in claim 2, wherein:

the lower surface of the front and rear pads being inclined upwardly toward the front of the board, with the rear pad having a larger angle than the front pad, whereby the effective pivot angle for the rear truck assembly between the board and wheels is larger than for the front truck assembly.

7. In a skateboard construction as claimed in claim 2 wherein:

each of said pads having a substantially rectangular shape.

8. In a skateboard as claimed in claim 1 wherein:

each of said pads being made of a hard resilient material.

9. The method of changing respective turn angles of the front and rear wheels on a skateboard having a board and truck assembly with wheels and a pivot axis defining turn angles for the front and rear wheels, comprising the steps of:

selecting a pair of wedge shaped, angle pads having top and bottom substantially flat surfaces that lie in intersecting planes, and mounting one of said pads between each of the front and rear truck assemblies and the board for supporting the board on said pads on said truck assemblies, wherein the step of selecting said pads include selecting pads with angles for altering the effective pivot angle of the truck assemblies between the board and the wheels.

* * * * *